United States Patent [19]

Werner

[11] Patent Number: 4,823,574

[45] Date of Patent: Apr. 25, 1989

[54] PERMUTATION LOCK

[75] Inventor: Hans U. Werner, Solingen, Fed. Rep. of Germany

[73] Assignee: S. Franzen Sohne GmbH & Co., Solingen, Fed. Rep. of Germany

[21] Appl. No.: 912,423

[22] Filed: Sep. 29, 1986

[51] Int. Cl.[4] ..... E05B 37/02

[52] U.S. Cl. ..... 70/312; 70/69; 70/74; 70/315

[58] Field of Search ..... 70/69–72, 70/74, 75, 77, 80, 304, 312, 314, 315

[56] References Cited

U.S. PATENT DOCUMENTS

| | | | |
|---|---|---|---|
| 745,664 | 12/1903 | Reiger | 70/70 |
| 1,723,020 | 8/1929 | Erwin | 70/72 |
| 2,136,493 | 11/1938 | Denerich | 70/80 |
| 2,163,853 | 6/1939 | Pond | 70/312 X |
| 2,737,800 | 3/1956 | Perkins | 70/312 |
| 3,459,016 | 8/1969 | Atkinson | 70/312 |
| 3,461,697 | 8/1969 | Gehrie | 70/71 |
| 3,677,042 | 7/1972 | Atkinson | 70/70 |
| 4,100,775 | 7/1978 | Bako | 70/70 X |
| 4,350,030 | 9/1982 | Bromley | 70/70 |
| 4,467,628 | 8/1984 | Zampini, Jr. | 70/312 |
| 4,574,601 | 3/1986 | Werk et al. | 70/70 |
| 4,671,088 | 6/1987 | Jeang | 70/312 |
| 4,682,483 | 7/1987 | Werner | 70/69 X |

FOREIGN PATENT DOCUMENTS

| | | | |
|---|---|---|---|
| 535569 | 2/1955 | Belgium | 70/70 |
| 0017539 | 10/1980 | European Pat. Off. | 70/71 |

*Primary Examiner*—Robert L. Wolfe
*Assistant Examiner*—Suzanne L. Dino
*Attorney, Agent, or Firm*—Burns, Doane, Swecker & Mathis

[57] ABSTRACT

A permutation lock comprises a housing having a rear wall and a front side closed off by a front plate. An axle extends transversely relative to a front-to-rear direction of the housing and carries rotary disks which project through slots in the front plate. A bolt is pivoted to the housing for rotation about an axis disposed parallel to the axle and situated immediately behind the front plate. The bolt extends rearwardly from the axis and has a locking portion at its rear end for engaging a hasp. Forwardly facing surfaces of the bolt engage and are cammed by the disks. The locking portion can extend through an opening in the rear wall and be shielded by a flap cut-out of the rear wall. Alternatively, the bolt can be V-shaped such that the locking portion extends from an apex of the V, the bolt is pivoted by one leg of the V, and the sensing surfaces are disposed on the other leg.

1 Claim, 7 Drawing Sheets

Fig. 4
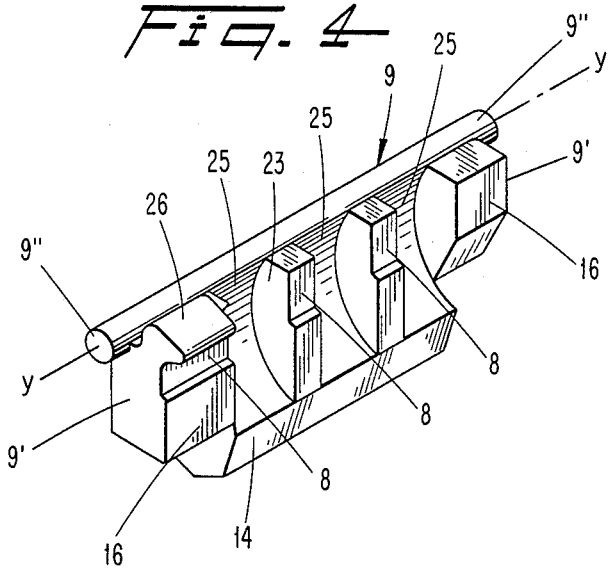
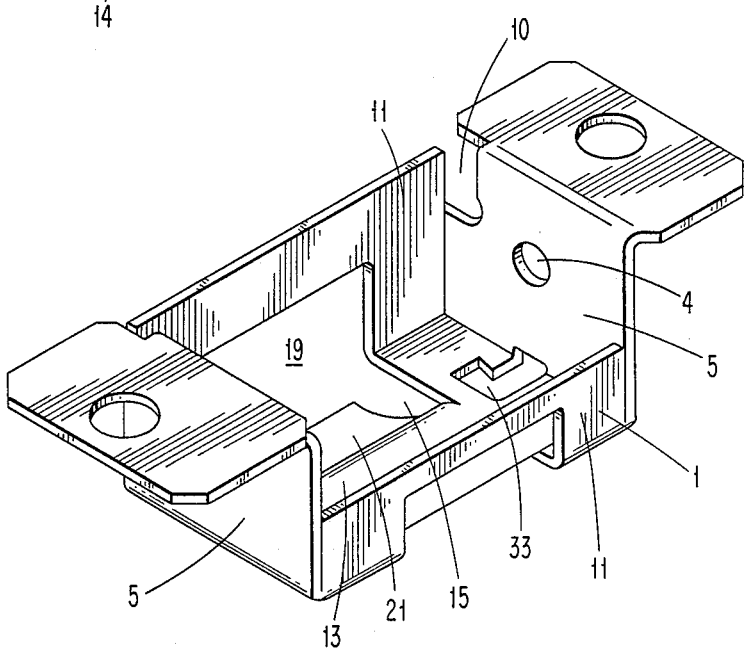
Fig. 5

Fig. 8
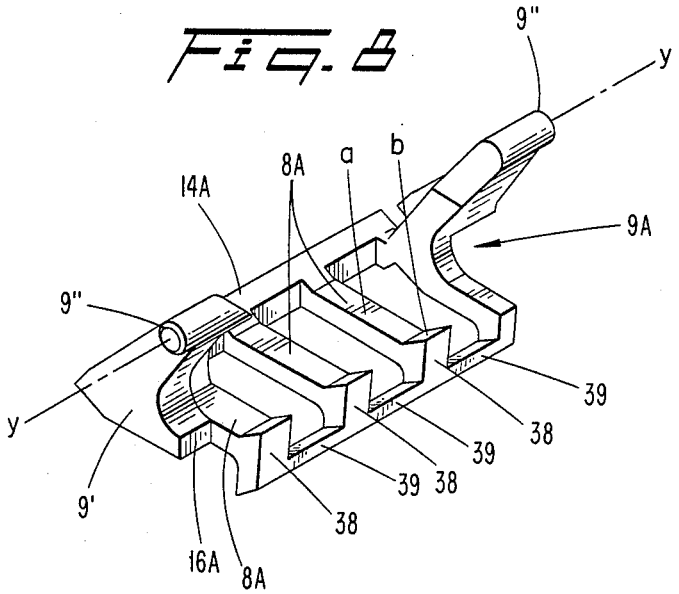
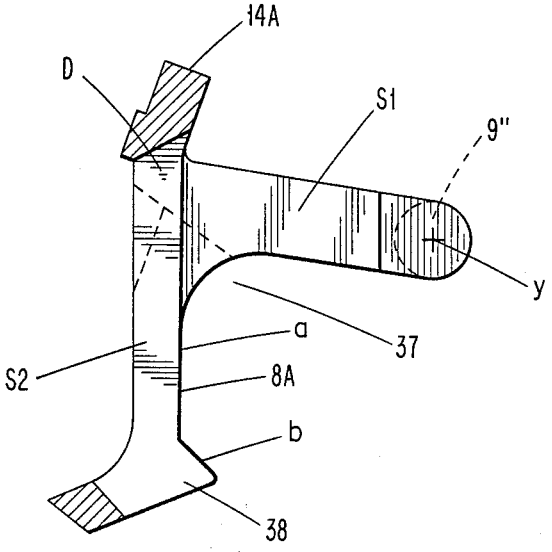
Fig. 9

PERMUTATION LOCK

BACKGROUND AND OBJECTS OF THE INVENTION

The invention concerns a permutation lock for cases such as suitcases and briefcases for example.

Such locks include an axle arranged in a lock housing for the support of a plurality of setting disks disposed longitudinally adjacent to each other and capable of rotation independently of each other from one locking position to another. A part of the disk circumference projects in an operationally accessible manner through slots of a front plate opposing the rear of the housing. Locking sleeves are associated with the disks in a spring loaded coupling engagement. Each sleeve includes a cylindrical collar which comprises an interruption, for example in the form of a flat, against which (in the case of a correctly set secret code) the sensing surface of a pivoting locking bolt abuts. An end of the bolt opposite its pivot axis is arranged in the vicinity of an opening in the housing for engaging a hasp on another section of the case.

A permutation lock of this type is known from U.S. Pat. No. 2,136,493. The pivoting bolt in that patent extends directly above the rear of the housing and essentially parallel to it. Since it is desirable that the depth of the case of such combination locks be as small as possible (i.e., from the front plate to the rear of the housing), in order to be able to install the lock without an overhang of the lock housing in the internal space of the suitcase, in most cases only a small pivoting angle is available, so that relatively complex locking heads must be used, for example in the form of a T-shaped overlap of the counter closing part inserted in a side wall. In order to improve the situation of the pivoting angle, the known combination lock has an excess depth which in itself is not necessary, thereby rendering this mass produced article more expensive.

It is an object of the invention to develop a combination lock of this generic type in a manner such that a functionally secure closing mode is obtained inspite of a small, compact configuration of the lock housing.

SUMMARY OF THE INVENTION

In accordance with the present invention, a permutation lock is provided which comprises a housing having a rear wall situated opposite to a front side of the housing. The rear wall and front side are spaced apart in a front to rear direction of the housing. The rear wall includes an opening therethrough. A front plate closes off the front side of the housing and includes slots. An axle is mounted in the housing and extends transversely of the front to rear direction. A plurality of sleeves are independently rotatably mounted on the axle and carry setting disks which project forwardly through the slots to be exposed for manual actuation. The sleeves carry collars, each of which includes an interruption in its outer periphery. A locking bolt is rotatably mounted in the housing for rotation about an axis oriented parallel to the axle and situated adjacent the front plate. The bolt extends rearwardly from the axis and includes locking means at a rear end thereof adapted to lockingly engage a hasp. The bolt includes sensing surfaces arranged to engage the collars for rotating the bolt into a hasp-unlocking position when the interruptions are sensed, and into a hasp-locking position when remaining larger diameter portions of the collar are sensed. A spring yieldably biases the bolt into engagement with the collars.

As a result of such a configuration, a permutation lock is provided with a compact structure and high functional safety. The depth of the lock housing in the front-to-rear direction is used to house the pivoting bolt which extends rearwardly from its axis along and essentially parallel to the longitudinal side walls of the housing. This eliminates the excess depth and height that is otherwise required and thus avoids an appreciable increase in the dimensions of the housing. The result is an improved utilization of the space of the lock housing and an even more compact configuration may be possible. The axis is located directly behind the front plate (a location more favorable for installation), and the locking bolt extends from there rearwardly toward an opening on the rear side of the lock housing. The end forming the locking head acts directly through the rear opening, whereby the part of the lock housing which is always unobstructed, is used for locking. The internal wall of the suitcase may now extend without being interrupted by a bulge created by an overhanging of the walls of the lock housing.

In one embodiment the pivoting bolt projects through the opening in the rear wall of the housing and has a plate-shaped broad surface resting directly in a cut-out of the longitudinal wall of the housing. The cut-out permits an even larger pivot angle for the bolt, as the wall thickness is also being utilized for that motion. The plate-shaped broad surface simultaneously acts as a displaceable protective wall covering the internal setting mechanism. Therefore, for example stamping burrs of the passage in the suitcase wall cannot get into the setting mechanism. In order to protect the locking bolt head against loading by the contents of the suitcase, it is found to be advantageous to have the end forming the locking head covered by a flap of the housing rear. The material (flap) cut free in the forming of the opening thus does not become wasted and even contributes to the overall stabilization of the rear zone, for example, by means of an angular shape corresponding to the shape of the locking head. In order to additionally close off the front ends of the flap, a protective cap may be provided in keeping with the structural arrangement.

The overall detailed configuration of the locking bolt is such that the sensing surfaces are formed by ribs protruding from the reverse side of the broad surface of the pivoting bolt. In addition to the sensing function, the ribbed structure produces a high internal stability of the directly loaded pivoting bolt. By providing the pivoting bolt with a locking finger which in the locking position of the lock is located adjacent to the collar of a locking sleeve to block the axial displacement of the locking sleeve in relation to the setting disk, any alteration of the code is excluded, as the changing of the code would require the decoupling of the locking sleeves from the setting disks.

In another embodiment of the invention the bolt has a roof-like cross section, wherein the slopes of the roof coverage to form a ridge. The bearing seat is located at the end of one of the slopes of the roof, while the other slope has one end engaging the hasp and includes a side facing the inside of the roof on which the sensing surfaces are formed. This configuration leads to a compact structure. The pivoting bolt, which is basically angle-shaped, receives in its apex area the locking sleeve to be sensed. It is, therefore, not necessary to provide an appreciable overhang over the diameter of the setting disks which determine the cross-section. A further feature involves combining the sensing surface of two plane segments set at an angle to each other, one of which abuts the flat of the collar in the unlocking position, and the other of which forms an obtuse angle with the first segment and rests against the circumferential surface of the collar in the locking position. The second segment comprises a hump-like projection and protrudes freely past the flat of the collar in the unlocking position. By means of such an extension, even in the presence of a relatively long flat an accurately defined sensing process is obtained, even in the case of narrow setting intervals of the setting disk. The flat may even extend over an angular range of 90°. The adjacent locking positions apply no torque in the opening direction.

BRIEF DESCRIPTION OF THE DRAWING

Further advantages and details of the permutation lock according to the invention will become more apparent hereinbelow from two embodiments thereof described with reference to the drawings wherein:

FIG. 4 depicts the pivoting bolt in a perspective view;

FIG. 5 is a perspective view of the lock housing with the opening in the rear wall extending to a longitudinal side wall;

FIG. 8 depicts the pivoting bolt in an individual perspective view, and

FIG. 9 depicts the bolt in cross-section.

DETAILED DESCRIPTION OF PREFERRED EMBODIMENTS OF THE INVENTION

Figure 1:
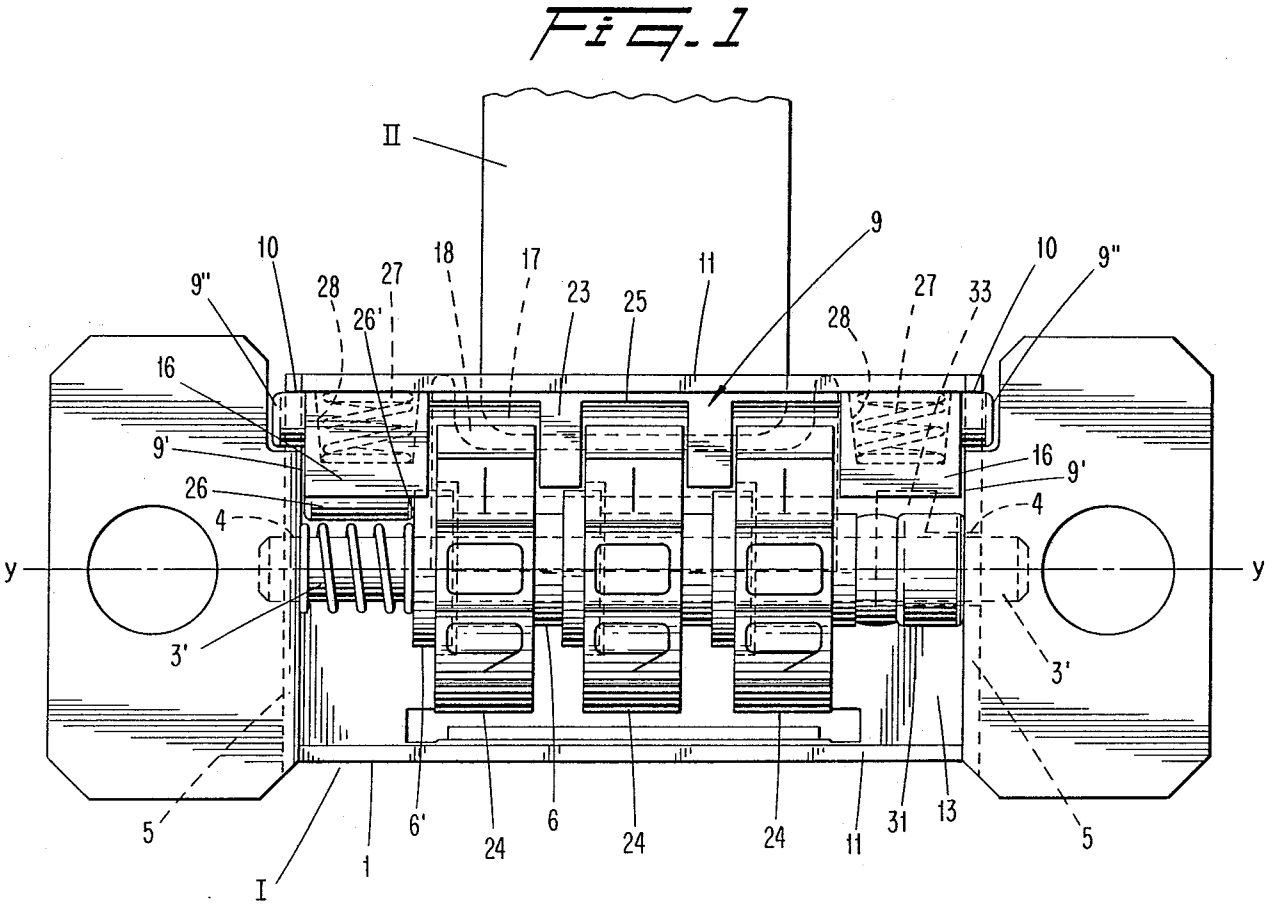
FIG. 1 is a front view of a permutation lock with the front plate removed, according to a first embodiment of the invention.

The lock shown comprises a permutation lock part I and a counter closing part or hasp II. The part I may be mounted to a lid L of a case such as a suitcase, and the hasp II mounted to the part B. The parting line F (FIG. 3) may be defined by coplanar walls of the case as depicted in solid lines in FIG. 3 or by perpendicularly oriented walls as depicted in phantom lines in FIG. 3. The lid L swings in a direction indicated by the arrow P. The parts B and L include front surfaces BS and LS, respectively, which lie in a common plane when the lid is closed.

The permutation lock part I comprises a box-like lock housing 1 having an open front side for the insertion of a setting mechanism, the open side being covered by a front plate 2. An axle 3 of the setting mechanism extends inside the lock housing in the longitudinal center plane, i.e., midway along the height of the housing 1. The axle ends 3' are supported in recesses 4 of end walls 5 of the lock housing. The axle 3 is mounted in a displaceable manner in the walls and is provided with the necessary excess length to accommodate such movement.

Figure 3:
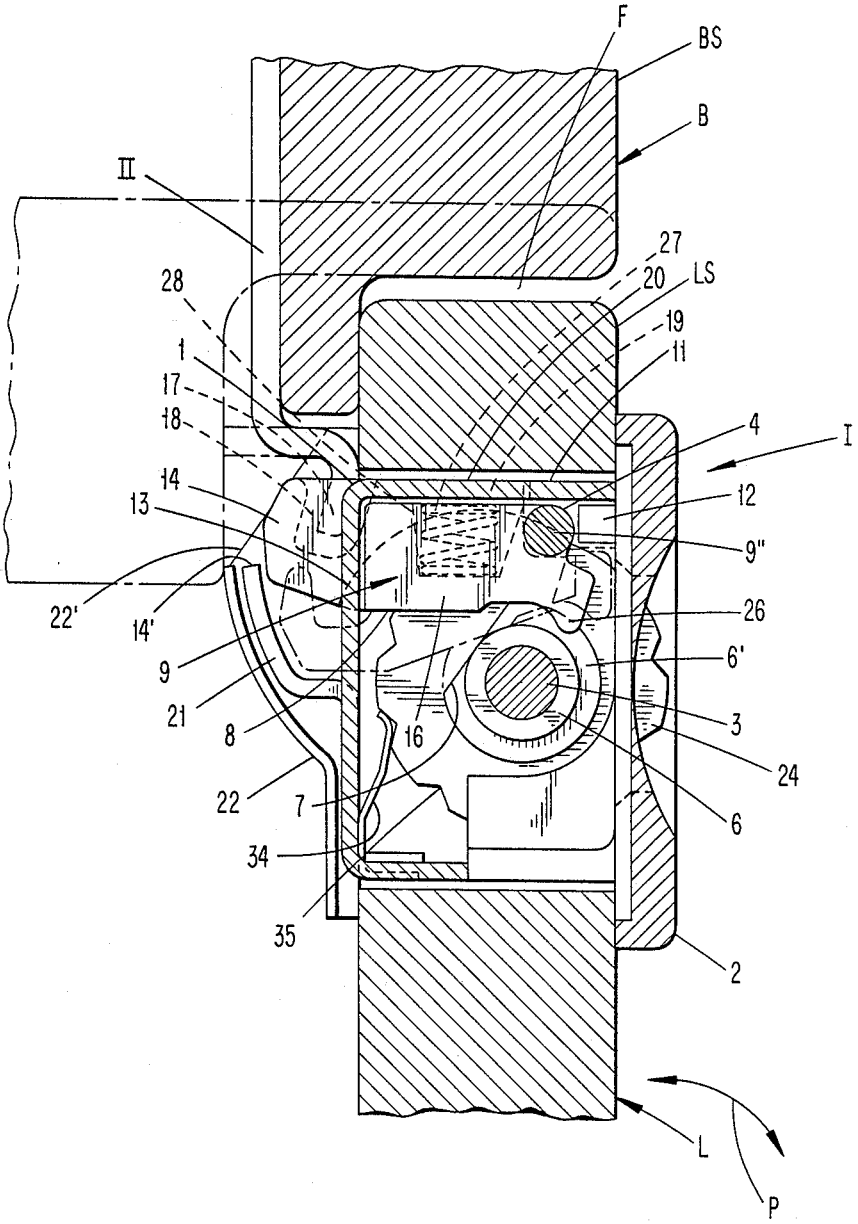
FIG. 3 is a sectional view on the line III—III in FIG. 2 with the locking position depicted in solid lines and the unlocking position depicted in broken lines.
Figure 6:
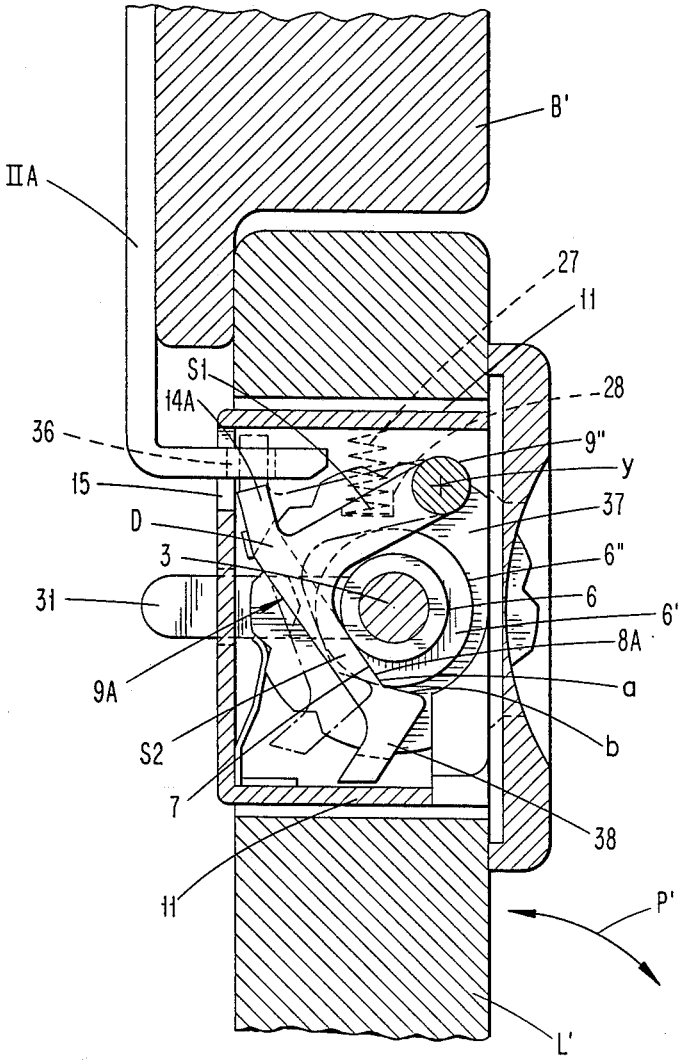
FIG. 6 is a view similar to FIG. 3 of a second embodiment of the invention which contains a modified form of pivoting bolt with the unlocking position depicted in solid lines and the locking position in broken lines.
Figure 7:
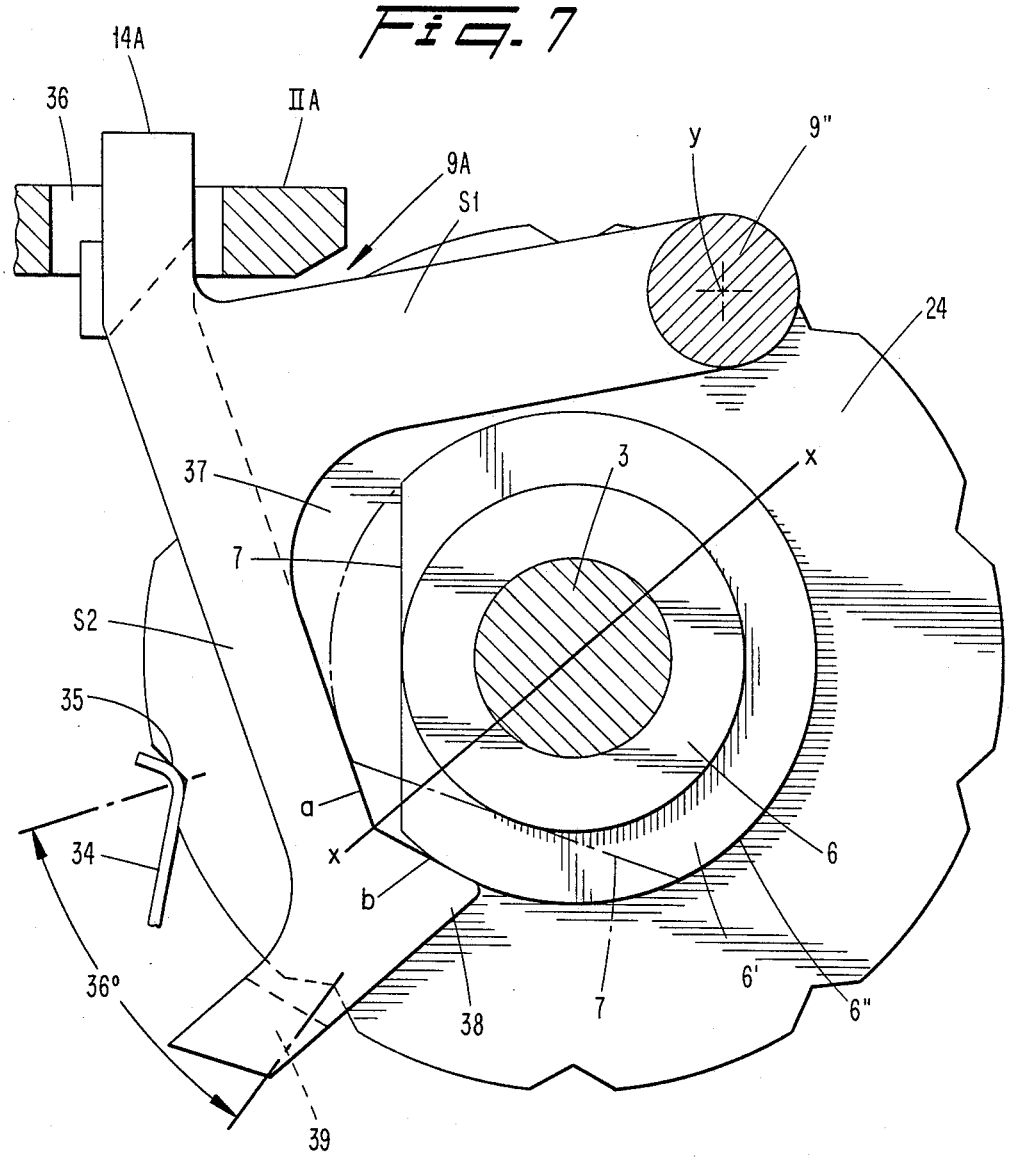
FIG. 7 is a fragmentary view of the bolt in the locking position.

The setting mechanism further comprises a plurality of locking sleeves 6. The latter are aligned in a row in contact with each other along the axle 3 and are displaceable thereon to a limited extent. Each of the locking sleeves includes a collar 6' which comprises on its periphery an interruption, or section of reduced cross section, in the form of a flat 7. If the code is accurately set, the flat 7 will be located opposite sensing surfaces 8 of a pivoting bolt 9. The latter, shown in FIG. 4, is pivotably supported in the lock housing in the vicinity of the front plate 2 in pivot bearings 10. The latter comprise slots cut in the two end walls 5 in the immediate vicinity of a longitudinal side wall 11 of the housing and are freely accessible from the front (see FIG. 5). The mouths of these slots are closed-off by projections 12 of the front plate 2 (FIG. 3). Two axle stubs 9'' are molded onto the pivoting bolt 9 and extend beyond end faces 9' of the bolt 9. The stubs 9'' project into the slots 10 to define a tilting axle Y, which is parallel to the axle 3. The pivoting bolt 9 is of a length corresponding to that of the internal space of the lock housing. The bolt 9 basically comprises a plate-shaped base body which extends rearwardly from the pivot axle Y toward a rear wall 13 of the lock housing 1 substantially perpendicular to the front plate 2. The body extends generally parallel relative to the longitudinal side wall 11 of the housing and has a hook-shaped end 14 which travels transversely relative to the front-to-rear direction and extends through an opening 15 in the rear wall 13 to make connection with the hasp II outside the locking housing. As seen in FIG. 4, the ends of the hook 14 are slightly recessed inwardly relative to the end faces 9' of the pivoting bolt. End lugs 16 of the bolt extend to respective walls 5 of the housing and terminate short of the housing rear wall 13, while leaving an adequate free space for pivotal movement of the pivoting bolt.

The hook 14, which is particularly apparent in FIG. 3, forms a recess 18 which receives an S-shaped hook 17 of the hasp II. The recess 18 is approximately parallel to the housing rear wall 13. In contrast, the hook 17 has an angular configuration.

The longitudinal side wall 11 includes a hole 19 which is contiguous with the opening 15 in the rear wall 13. The hole 19 extends forwardly to lie even with rear ends of the slots 10. The hole 19 permits the partial immersion therein of a segment of the plate-shaped broad surface 20 of the pivoting bolt 9. The broad surface also functions to protectively cover the setting mechanism.

Figure 2:
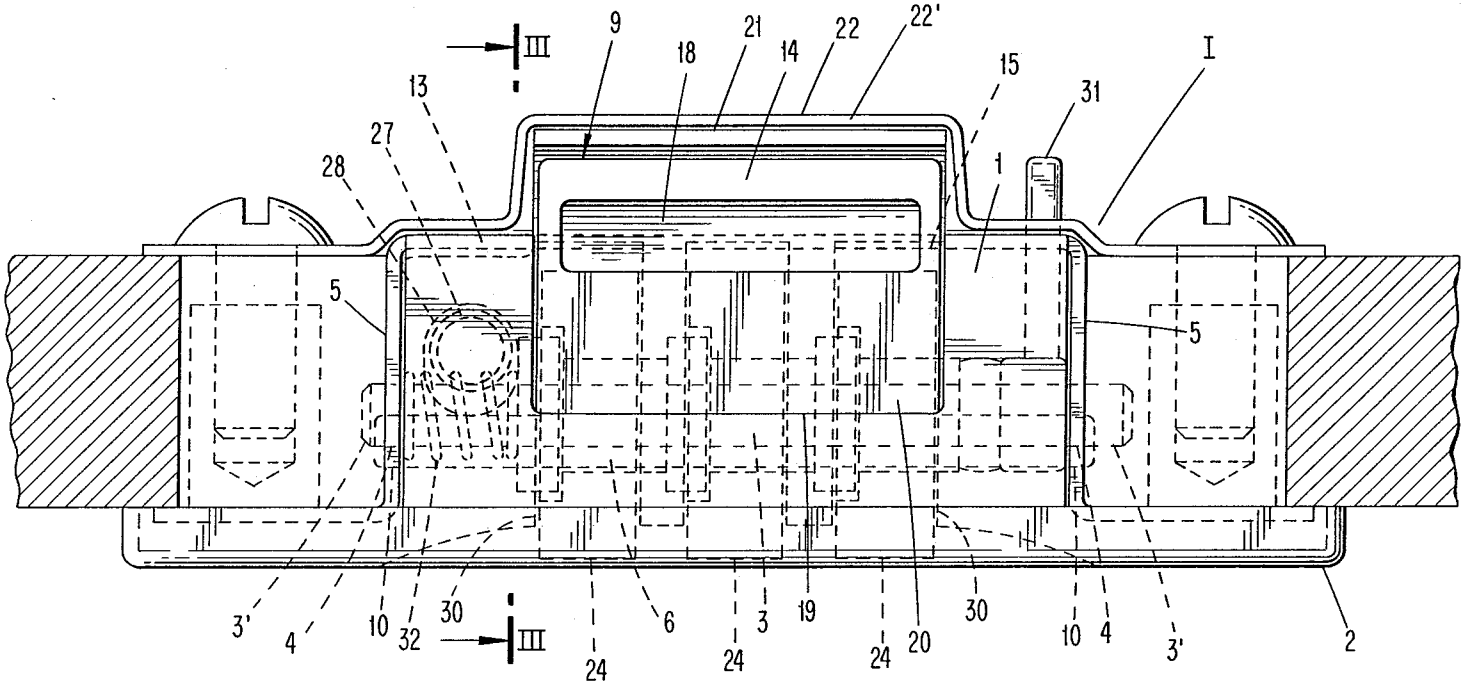
FIG. 2 is a top view of the lock.

The hook 14 of the bolt 9 is overlapped in a cap-like manner by a cut-out flap 21 of the housing rear wall 13 to protectively cover the setting mechanism. The flap has a curved configuration corresponding to the shape of the hook 14. The flap 21 initially extends rearwardly from the rear 13 and then extends toward the hasp II in a path having the axis Y as a center. A kind of a protective cover is created in this manner since the hook 14 travels within a space defined by the flap. In order to close-off the ends of the flap 21, an additional protective cap 22 is provided which comprises a member which is attached to the lock by mounting screws as depicted in FIG. 2. A terminal edge 22' of the cap 22 is aligned with a terminal edge 14' of the flap 21 (see FIG. 3).

The scanning or sensing surfaces 8 comprise the outer surfaces of ribs 23 located on the underside of the pivoting bolt 9, i.e., on the side opposite the broad surface 20. The surfaces 8 are spaced apart axially to define recesses which receive the setting disks 24. The floor 25 of each recess has a concave configuration corresponding to the cylindrical circumference of the disk periphery.

The pivoting bolt 9 further comprises a locking finger 26, which in the locking position is located adjacent to the collar 6' of one of the locking sleeves 6, thereby blocking the axial displacement of the locking sleeve 6 relative to the setting disk 24. The locking position is shown in FIG. 1 and in solid lines in FIG. 3. It may be seen that the free end 26' of the locking finger is located within the cross-sectional area of the collar (FIG. 3). If the pivoting bolt is moved into the open position (depicted in FIG. 3 by dash-and-dot lines), the locking finger is moved out of the collar zone 6' in the radial direction. This position is the only one permitting a resetting of the code by a mechanism described hereafter.

The pivoting bolt 9 is spring loaded by two helical compression springs 27 which are holding it in sensing contact with the collar 6'. The compression springs 27 are located in recesses 28 of the end lugs 16, which recesses are open toward the longitudinal side wall 11 of the housing. The springs thus act between the wall 11 and the bolt 9. The springs are located approximately half-way between the rotary axis Y and the hook 14 of the pivoting bolt 9.

The quantity of setting disks 24 corresponds to that of the locking sleeves; the disks 24 project partially through slots 30 of the front plate 2 and are accessible for actuation. The setting disks include center hubs disposed in coupling engagement with the locking sleeves 6. The coupling engagement is effected by means of conventional joining projections, not shown in detail, protruding from the sleeves into fitting recesses of inner teeth of the setting disks 24. The releasing outward motion of the locking barrels for the resetting of the code is effected by means of an actuating lever 31, fixedly connected with the axially displaceable axle 3. The outward movement is effected against the force of a helical compression spring 32 threaded onto the axis, which is abutting at one end against an end-most locking sleeve 6 and at its other end against an end wall 5. The disengaging position of the actuating lever may be defined by means of a bayonet-like side slot 33 formed in the rear wall 13 of the housing (FIG. 5). The setting disks 24 themselves are not displaceable. Following the disengagement, the setting disks are rotated to set the new combination desired, which may be displayed for example by numerical symbols on the periphery of the setting disks.

The prevailing angular positions of the locking sleeves 6 and the setting disks 24 are locked-in by means of special lock springs 34. Locking heads of the latter enter into notch-like locking recesses 35 provided in a uniform angular distribution over the circumference of the setting disks 24 (FIG. 3).

A second preferred embodiment of the invention is disclosed in FIGS. 6–9 and comprises a permutation lock with the same fundamental configuration as disclosed above. The same reference symbols apply to similar parts. The lock is mounted on the lid L' which pivots in the direction indicated by the arrow P'. The pivoting bolt 9A has a cross section in the general shape of a roof or "V" in a manner such that the axle stubs 9'' are located at the end of one of the two legs or slopes S1 of the roof, the slopes S1, S2 converging to form a ridge D with the slope S2 extending at approximately a right angle relative to the first slope S1. A ledge-like end 14A of the second slope forms a locking head disposed at the ridge D and cooperating with a counter-closing part or hasp IIA, which in this case comprises a lug 36. This second roof slope S2 forms rungs comparable to the afore-described ribs 23 and defining sensing surfaces 8 which cooperate with flats 7 on the inside of the roof 37, i.e., the rungs project toward the axle 3. The cylindrical sleeve body is practically completely immersed (in a spacing saving manner) into a V-shaped space 37 formed by the two slopes S1, S2 of the bolt.

The free end of the second slope S2 forms a hump-like projection 38 which results in two plane segments a and b, located at an obtuse angle to each other. The bisecting line X—X of that angle intersects the axial center line of the axle 3 in the locked position of the permutation lock. In the open position, on the other hand, the line X—X extends slightly outside the axle 3 or is tangent to its periphery on the side facing away from the axis Y, and the longer plane segment a has its entire area engaged with the flat 7 (solid lines in FIG. 6). In the locking position (FIG. 7), on the other hand, the shorter plane segment b, which is located in the zone of the hump-like projection 38, overlaps the cylindrical part 6'' of the collar beyond the flat. The incremental locking steps of the setting disks are 36° apart.

As seen in the perspective view according to FIG. 8, the angular pivot lever 9A comprises a ladder-like base body, i.e., the lugs 16 and the freely placed rungs in between, are connected with each other by webs 39 extending in the longitudinal direction. The hump-like, ledge-shaped projection 38 continues slightly in the rearward direction, i.e., toward the other longitudinal wall 11 of the housing, which, if laid out appropriately, serves as a stop for the pivoting motion of the bolt 9A.

In this embodiment, the rear wall 13 has an opening for the entry of the hasp IIA. This opening 15 does not continue in the longitudinal side wall 11 of the housing. Locking takes place in the corner area of the case.

In order to keep the setting mechanism, in particular the pivoting bolt, free of locking stresses, the case may include auxiliary closures, e.g., push button closures which function to push the lid up in a lid-open position.

In each of the above-described embodiments, the bolt 9, 9A extends rearwardly from its pivot point substantially perpendicularly to the front plate 2 when in an on-lock condition and engages the hasp at its rear end. Therefore, the rotation of the bolt produces movement of the rear end of the bolt primarily in a direction transversely relative to the front-to-rear direction of the lock housing. Thus, the depth of the housing in the front-to-rear direction need not be as long as in the case of bolts conventionally arranged to pivot such that the rear end moves primarily in the front-to-rear direction.

Although the present invention has been described in connection with preferred embodiments of the invention, it will be appreciated by those skilled in the art that additions, modifications, substitutions, and deletions not specifically described may be made without departing from the spirit and scope of the invention as defined in the appended claims.

What I claim is:

1. In combination, a case comprising first and second parts, and a permutation lock for releasably securing said parts together, said first part forming a lid of said case and including a first front surface, said second part including a second front surface disposed in a common plane with said first front surface when said lid is in a closed position, said second part carrying a hasp, said lid being hingedly coupled to said second part for rotation out of said closed position in a direction perpendicular to said front surface, said lock mounted on said first part and comprising:

a housing having a rear wall situated opposite to a front side of said housing, said rear wall and front side being spaced apart in a front-to-rear direction of said housing, said rear wall including an opening, a front plate oriented parallel to said common plane and arranged for closing said front side of said housing, said front plate including slots, an axle mounted in said housing and extending transversely of said front-to-rear direction, a plurality of sleeves independently rotatably mounted on said axle and carrying setting disks which project forwardly through said slots to be exposed for manual actuation, said sleeves carrying collars which each includes an interruption in its outer periphery, a locking bolt rotatably mounted in said housing for rotation about an axis oriented parallel to said axle and situated adjacent said front plate, said bolt including a portion extending rearwardly from said axis and substantially perpendicularly to said front plate when in an on-lock condition, and including locking means at a rear end thereof movable in a direction transversely of said front-to-rear direction during rotation of said bolt to lockingly engage or disengage said hasp, said bolt including sensing surfaces arranged to engage said collars for rotating said bolt into a hasp-unlocking position when said interruptions are sensed and into a hasp-locking position when remaining portions of said collar are sensed, and spring means yieldably biasing said bolt into engagement with said collars.

* * * * *